US006459413B1

(12) United States Patent
Tseng et al.

(10) Patent No.: US 6,459,413 B1
(45) Date of Patent: Oct. 1, 2002

(54) MULTI-FREQUENCY BAND ANTENNA

(75) Inventors: Wen-Jen Tseng, Kaohsiung; Jyh-Wen Sheen, Hsinchu, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 8 days.

(21) Appl. No.: 09/758,598

(22) Filed: Jan. 10, 2001

(51) Int. Cl.[7] ..... H01Q 1/24; H01Q 1/38; H01Q 1/36

(52) U.S. Cl. ..... 343/702; 343/700 MS; 343/895

(58) Field of Search ..... 343/895, 700 MS, 343/702, 850, 873, 893

(56) References Cited

U.S. PATENT DOCUMENTS 5,870,066 A * 2/1999 Asakura et al. ..... 343/895
5,926,139 A 7/1999 Korisch
6,028,567 A * 2/2000 Lahti ..... 343/895
6,054,966 A 4/2000 Haapala
6,069,592 A * 5/2000 Wass ..... 343/895
6,100,848 A * 8/2000 Hayes ..... 343/702
6,130,651 A * 10/2000 Yanagisawa et al. ..... 343/895
6,166,694 A * 12/2000 Ying ..... 343/702
6,184,836 B1 * 2/2001 Ali ..... 343/702
6,198,442 B1 * 3/2001 Rutkowski et al. ..... 343/702

* cited by examiner

*Primary Examiner*—Don Wong
*Assistant Examiner*—Hoang Nguyen

(57) ABSTRACT

An antenna operable in multiple frequency bands used in a personal wireless communication device comprises a first radiating element, a second radiating element, and a feed radiating element. The first radiating element is shaped as an extended bent wire to function as an antenna for a first frequency band. The second radiating element functions as an antenna for a second frequency band. The feed radiating element has at least two ends. One end is used as a signal feed point so that first and second frequency signals can share the same signal feed point. The other end electrically connects the first radiating element to the second radiating element and forms a top loaded structure. The extended bent wire antenna effectively reduces the overall length of the antenna.

17 Claims, 11 Drawing Sheets

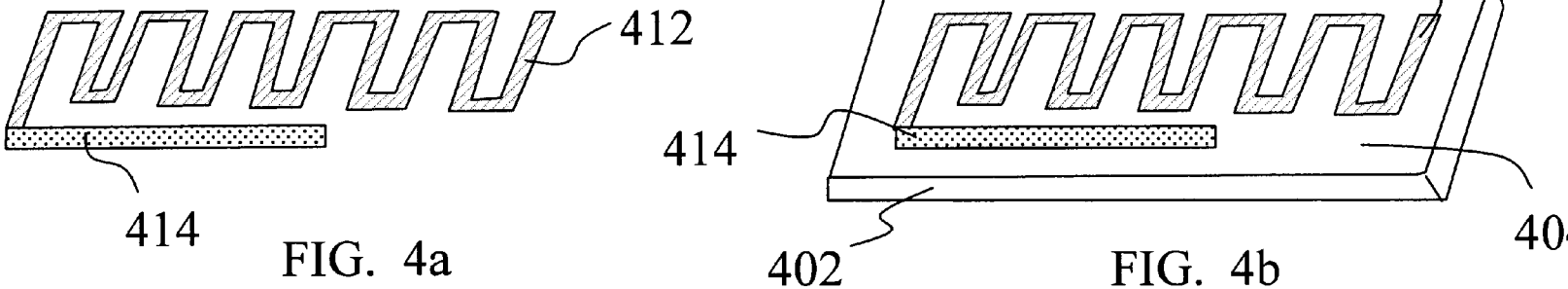
FIG. 4a
FIG. 4b
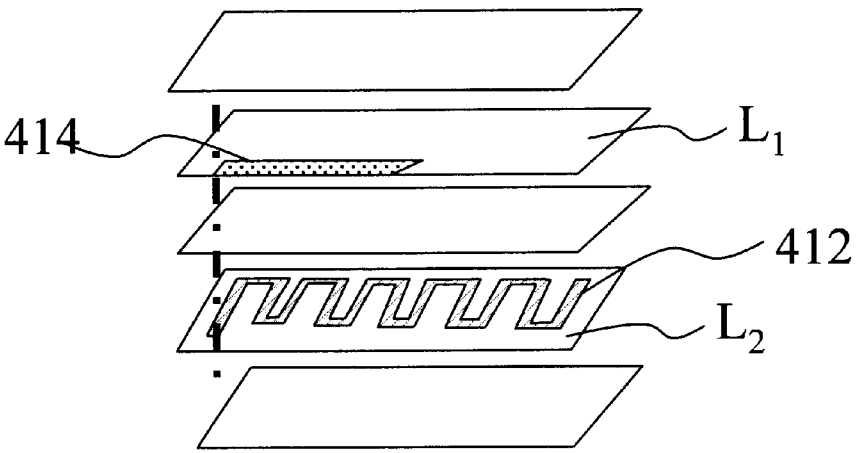
FIG. 4c

MULTI-FREQUENCY BAND ANTENNA

FIELD OF THE INVENTION

The present invention relates generally to an antenna, and more particularly to a multi-frequency band antenna for use in a wireless communication device.

BACKGROUND OF THE INVENTION

In recent years, personal wireless communication devices have become increasingly popular. To provide consumers with a wireless communication service of multiple functions, the design of cellular phone modules operating in two or more frequency bands is gaining popularity. Thus, there exists a need for an antenna, which is responsible for transmitting and receiving signals, capable of operating in two or more frequency bands.

Antennas are generally divided into hidden and non-hidden types by their appearance. Most non-hidden type antennas are made by an antenna structure comprising a wire antenna element and a helix antenna element in order to operate in two frequency bands. U.S. Pat. No. 6,054,966 discloses an antenna structure with at least two resonance frequency bands. As shown in FIGS. 1*a* and 1*b*, the antenna structure 100 comprises a first antenna element (P2 or P3) which is preferably a straight conductor, and a second antenna element (HX3 or HX4) which is preferably a conductor wound into a cylindrical coil, with the two antenna elements having different resonance frequencies. The rod element (P2 or P3) is partly inside the other antenna element (HX3 or HX4) and they may comprise a same feed point A4 or separate feed points A5 and A6. The antenna structure may also comprise a third antenna element (not shown in FIGS. 1*a* and 1*b*) which is preferably a conductor wound into a cylindrical coil comprising a different resonance frequency from those of the other two antenna elements.

The antenna structure disclosed in the U.S. patent is widely used in a mobile phone operating(, in at least two cellular telephone systems using different frequencies. However, such an antenna needs to be assembled in such a way that it is extendable out of the device case, and the extended antenna may easily be broken or damaged due to user's carelessness.

Hidden type antennas are mainly designed in accordance with the principle of a planar inverted F-antenna. U.S. Pat. No. 5,926,139 discloses a single planar antenna for use in two frequency bands. As shown in FIG. 2, the planar antenna includes a first radiating portion 202 and a second radiating portion 204. The two radiating portions for the two bands are joined by the connecting portion 208 of a conductive layer 206 and spaced from the ground plane 210 of the conductive layer 206. Each radiating portion is formed as a planar inverted F-antenna on the conductive layer 206. The conductive layer is preferably a metallic layer. A grounding pin 212 interconnects the connecting portion 208 and the ground plane 210 and a single feed pin 214 connects the connecting portion 208 to the input/output port of a transceiver circuitry.

The planar antenna is designed by forming a slit on a planar patch in order to operate in both of the desired frequency bands. However, such an antenna has a drawback that its operable frequency bandwidth reduces as the size of the planar patch is reduced. Therefore, the antenna may only operate in a smaller frequency range to compromise with the small size.

SUMMARY OF THE INVENTION

The present invention has been made to overcome the above-mentioned drawbacks of a conventional antenna. The primary object of the invention is to provide an antenna operable in multiple frequency bands used in a personal wireless communication device. The multi-frequency band antenna comprises a first radiating element, a second radiating element, and a feed radiating element. The first radiating element made of a conductive material is shaped as an extended bent wire to function as an antenna element for a first frequency band to control the characteristics of the first frequency band. The second radiating element also made of a conductive material functions as an antenna element for a second frequency band to control the characteristics of the second frequency band.

The multi-frequency band antenna comprises a feed radiating element having at least two ends. One end is used as a signal feed point so that the first frequency signal and the second frequency signal can share a same signal feed point. The other end electrically connects the first radiating element to the second radiating element to form a top loaded structure. According to the invention, the multi-frequency band antenna uses the top loaded structure as well as the design of the extended bent wire antenna to achieve two resonance frequencies, wide frequency bands and the hidden nature.

The object of the design of the extended bent wire antenna is to effectively reduce the overall length of the antenna. The object of the top loaded structure is to change the antenna's extension direction so that the antenna can be completely placed and hidden in the case of a mobile phone. In addition, low cost is another object of the multi-frequency band antenna of the invention. Because the antenna can be fabricated by popular materials, the material and manufacturing cost can thus be reduced substantially. It is very suitable for mass production and is highly competitive in the market.

In the preferred embodiments of the invention, the first radiating element uses an extended bent wire with an extended square-wave pattern, an extended saw-tooth pattern, an extended sinusoid pattern or combinations of those patterns. It is used to control the characteristics of the lower frequency band of the antenna and to reduce the overall length. The central frequency and the bandwidth of the antenna can be adjusted by controlling the length of the bent metal wire and the number of bends. The second radiating element is a straight conductor. It is used to control the characteristics of the higher frequency band of the antenna. The central frequency and the bandwidth of the higher frequency band of the antenna can be adjusted by controlling the length and the width of the straight conductor. This straight metal wire can be implemented with extended bent patterns.

The feed radiating element has three preferred embodiments according to the invention. One embodiment is a metal wire without a base. Another two embodiments are metal wires with a base. The metal wires are respectively placed on the top surface and in the interior of the base. Similarly, the two radiating elements also have three preferred embodiments. One embodiment is two metal wires without a base. Another two embodiments are two metal wires with a base. Metal wires are respectively placed on the top surface and in the interior of the base and can be distributed in different layers. The surface for placing the metal wires can be a plane or a curved surface.

The invention uses a two-frequency band antenna and a commercial three-frequency band antenna to analyze the measurement results of the return loss of the multi-frequency band antenna of the invention. The operating range of the two-frequency band antenna is designed in GSM 900 and DCS 1800 frequency bands. The bandwidths at −10 dB are 130 MHz and 230 MHz, respectively. The higher frequency range of the commercial three-frequency band antenna can include DCS 1800 and PCS 1900 frequency bands.

The foregoing and other objects, features, aspects and advantages of the present invention will become better understood from a careful reading of a detailed description provide(l herein below with appropriate reference to the accompanying drawings.

BRIEF DESCRIPTION OF THE DRAWINGS

FIGS. 4*a*–4*c* show respectively three embodiments of a multi-frequency band antenna having a first radiating element and a second radiating element according to the invention.

DETAILED DESCRIPTION OF THE PREFERRED EMBODIMENTS

Figure 1A:
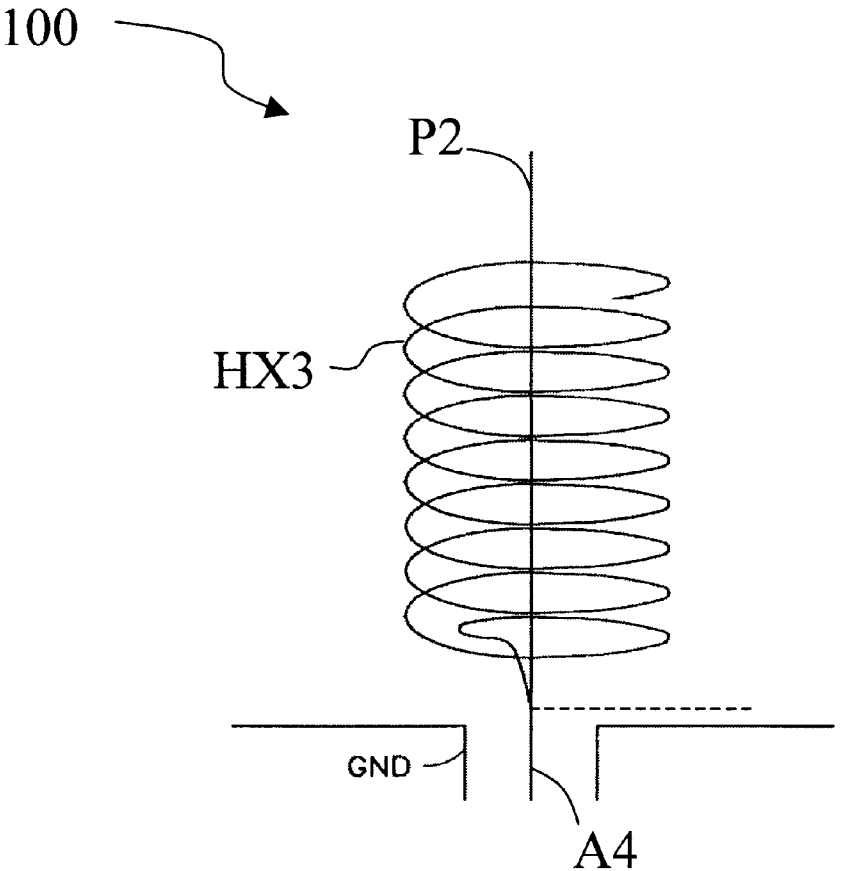
FIG. 1a (PRIOR ART)
FIG. 1 is a schematic view of a conventional antenna structure with at least two resonance frequency bands.
Figure 1B:
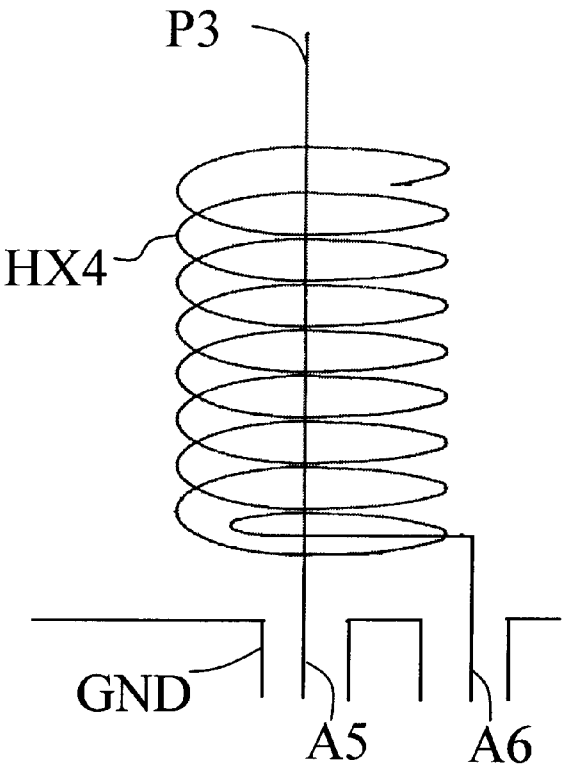
FIG. 1b (PRIOR ART)
Figure 2:
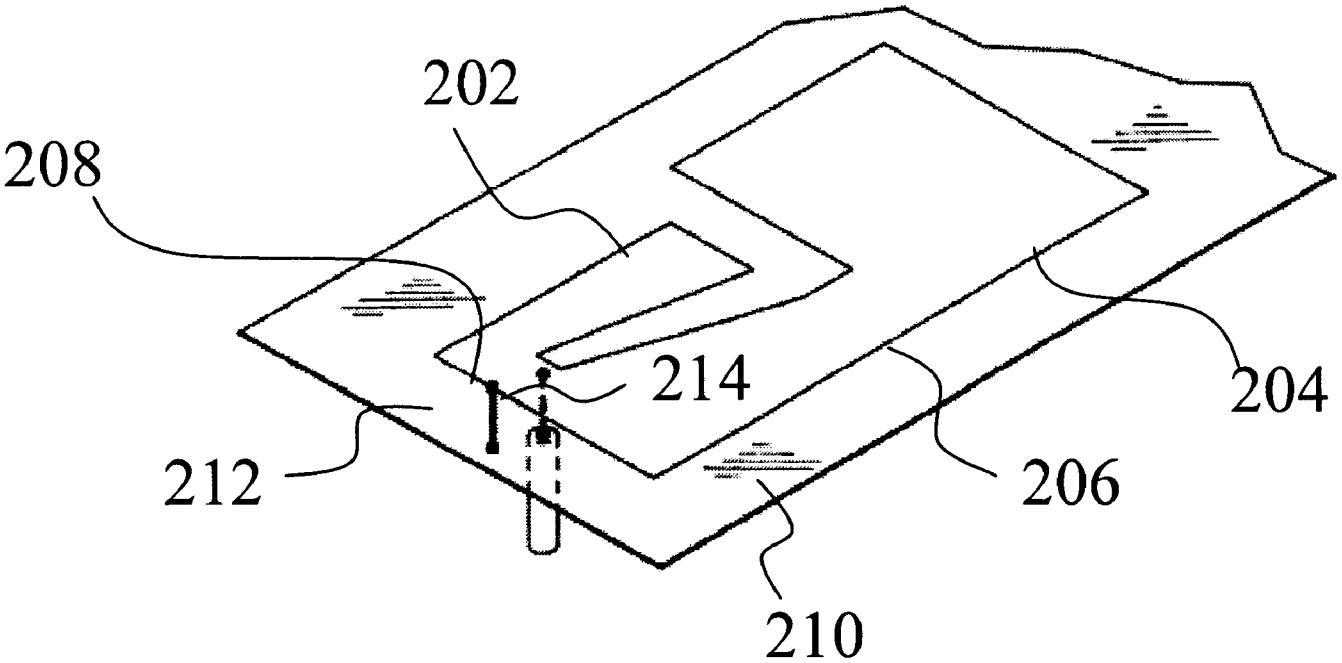
FIG. 2 (PRIOR ART)
FIG. 2 is a schematic view of a conventional planar antenna for use in two frequency bands.
Figure 3:
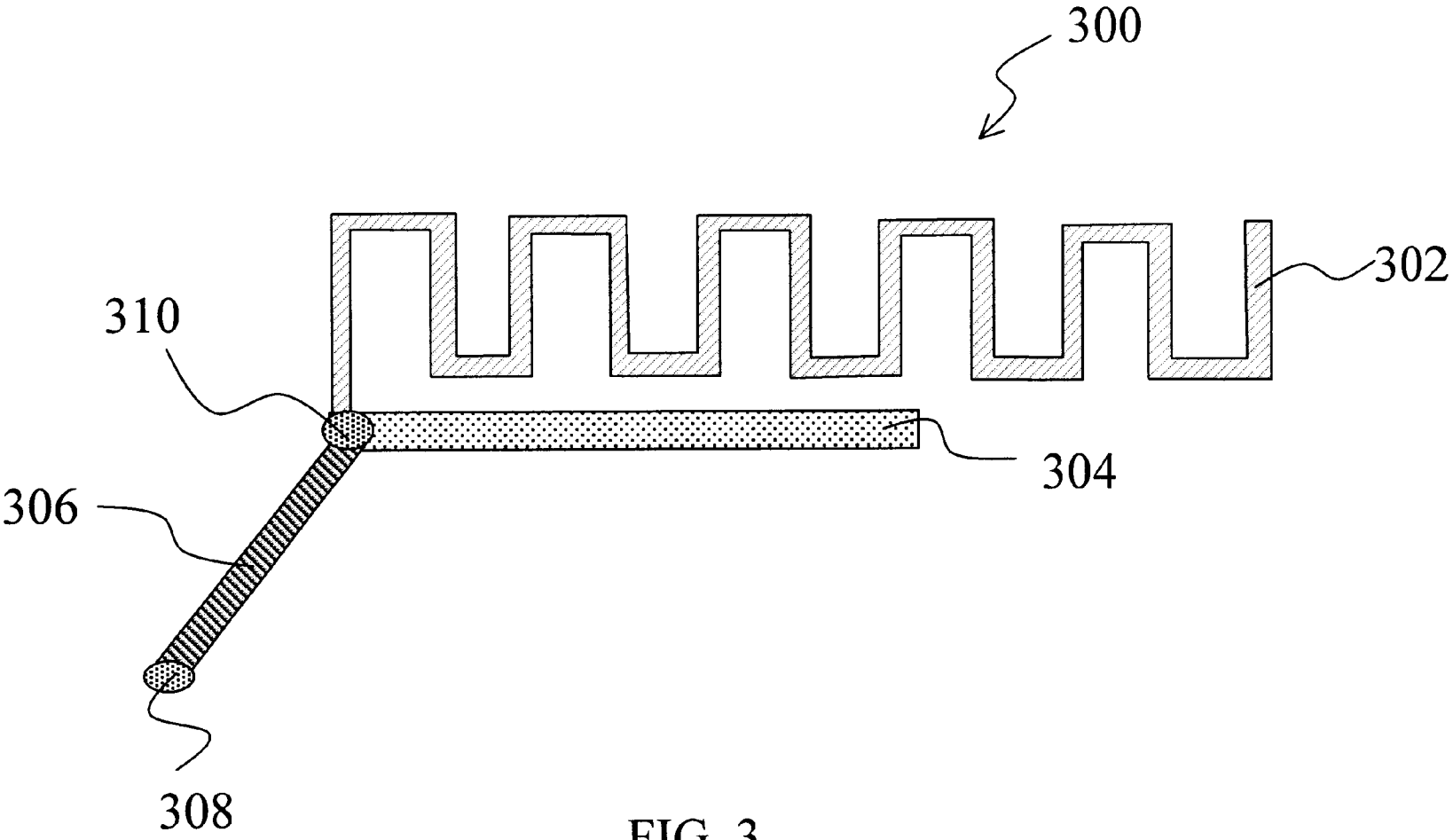
FIG. 3 shows a preferred embodiment of an antenna operable in multiple frequency bands according to the invention.

FIG. 3 shows a preferred embodiment of an antenna operable in multiple frequency bands according to the invention. As shown in FIG. 3, the antenna 300 comprises a first radiating element 302, a second radiating element 304, and a feed radiating element 306. The first radiating element 302 is shaped as an extended bent wire to function as an antenna element for a first frequency band. It is used to control the characteristics of the first frequency band. The second radiating element 304 functions as an antenna element for a second frequency band. It is used to control the characteristics of the second frequency band.

The feed radiating element 306 of the multi-frequency band antenna has two ends. One end is used as a signal feed point 308 so that the first frequency signal and the second frequency signal can share a same signal feed point 308. The other end 310 electrically connects the first radiating element 302 to the second radiating element 304 and forms a top loaded structure. The top loaded structure changes the antenna's extension direction. Therefore, the antenna can be completely placed and hidden in the case of a mobile phone. According to the invention, the first frequency band is different from the second frequency band. Also. the first radiating element 302, the second radiating element 304 and the feed radiating element 306 are made of conductive materials such as metal.

FIGS. 4*a*–4*c* show respectively three different embodiments of a multi-frequency band antenna having the first radiating element 302 and the second radiating element 304. Referring, to FIG. 4*a* which shows the first embodiment, an antenna element as the first radiating element 302 and an antenna element as the second radiating element 304 are respectively two metal wires 412 and 414 without a base. As shown in FIG. 4*b*, in the second embodiment the metal wires 412 and 414 are placed on the top surface 404 of a base 402. The third embodiment has a layered base structure as shown in FIG. 4*c*. The metal wires 412 and 414 are placed in the interior layers of the base and distributed in different layers $L_1$ and $L_2$. According to the invention, the surface for placing the metal wires 412 and 414 can be a plane or a curved surface. The surfaces shown in FIGS. 4*b* and 4*c* are planar.

Figure 5B:
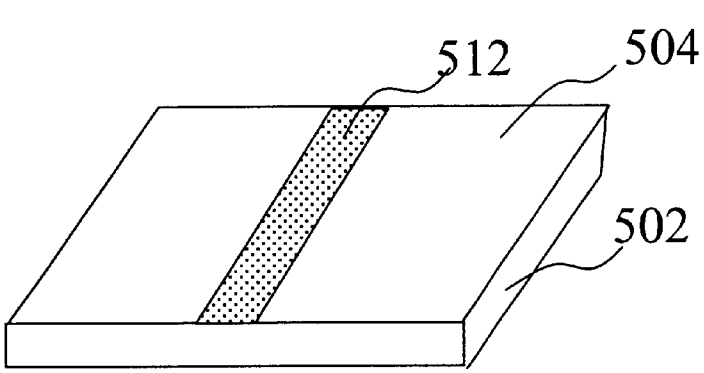
FIGS. 5*a*–5*c* show respectively three embodiments of the feed radiating element according to the invention.
Figure 5A:
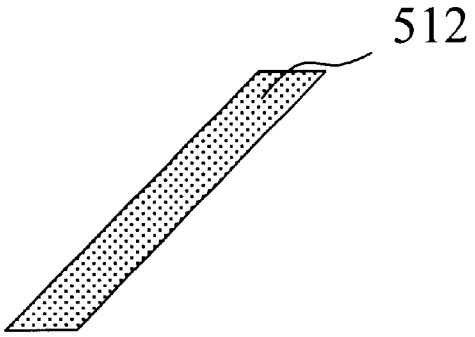
Figure 5C:
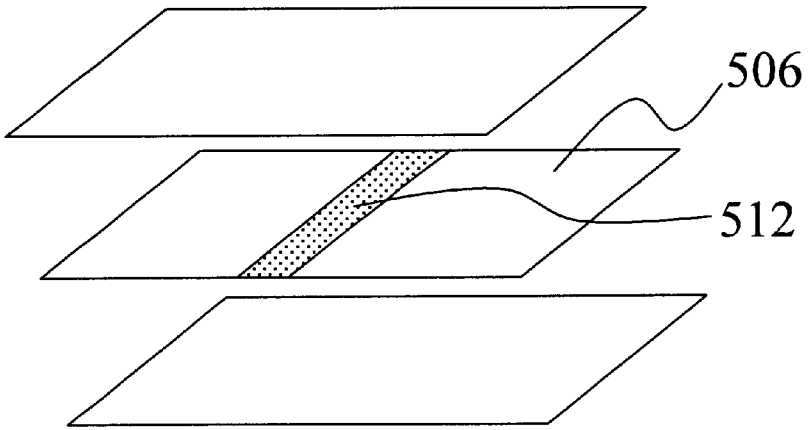

Similarly, the feed radiating element 306 also has three different embodiments according to the invention as shown in FIGS. 5*a*–5*c*. FIG. 5*a* shows that the feed radiating element 306 is manufactured by a metal wire 512 without a base. FIG. 5*b* shows that a metal wire 512 is placed on the top surface 504 of a base 502. FIG. 5*c* shows that a metal wire 512 is placed in the interior layer 506 of a base 502 which has a multi-layer structure. The bases shown in FIGS. 4*b*–4*c* and FIGS. 5*b*–5*c* are made of dielectric material such as ceramic materials or FR4 boards.

Figure 6:
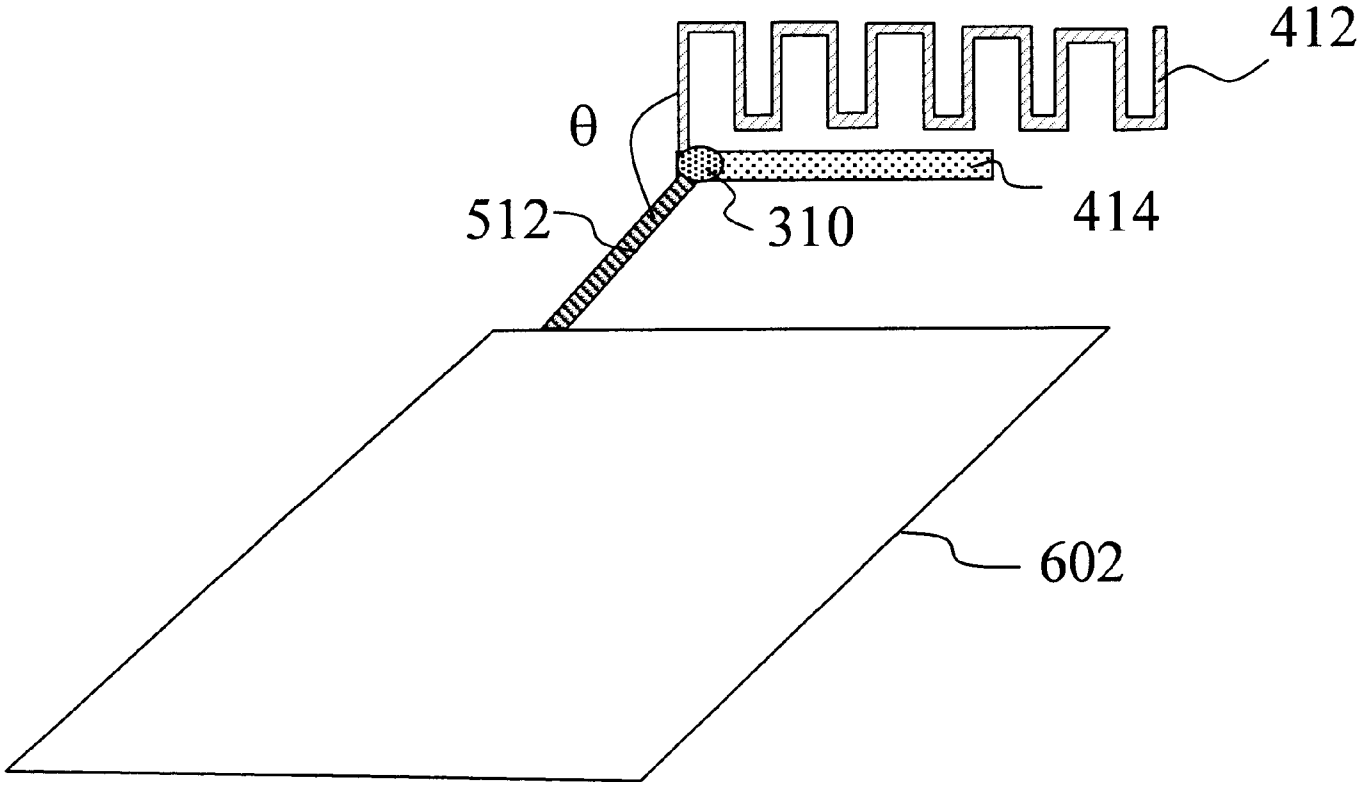
FIG. 6 is a schematic view of a multi-frequency band antenna assembled with a printed circuit board in a case of a mobile phone, using the radiating elements of FIG. 4*a* and the feed radiating metal wire of FIG. 5*a* according to the invention.

FIG. 6 shows a multi-frequency band antenna assembled with a printed circuit board 602 in a case of a mobile phone using the metal wires 412 and 414 without a base as shown in FIG. 4*a* and the feed radiating metal wire 512 without a base shown in FIG. 5*a* according to the invention. The angle θ between the feed radiating metal wire 512 and the plane containing the metal wires 412 and 414 can be a right angle, an acute angle or an obtuse angle to prevent having a protrusive portion. A preferred range of the angle is from 70° to 180°.

Figure 7A:
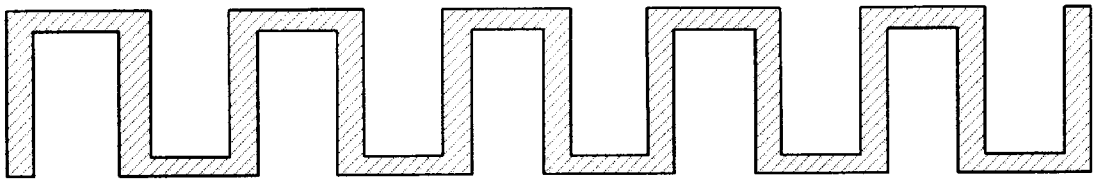
FIGS. 7*a*–7*c* show respectively three preferred embodiments of the extended bent wire for the first radiating element according to the invention.
Figure 7B:
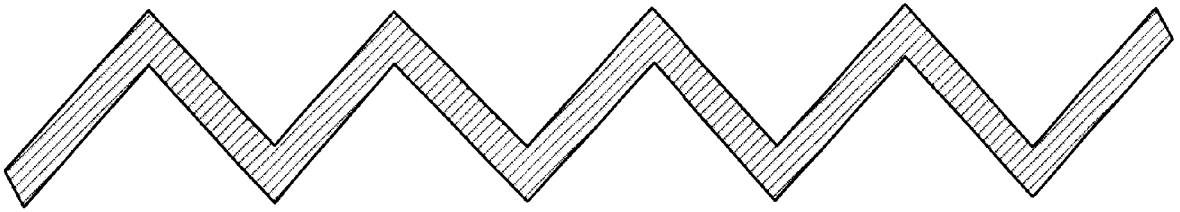
Figure 7C:
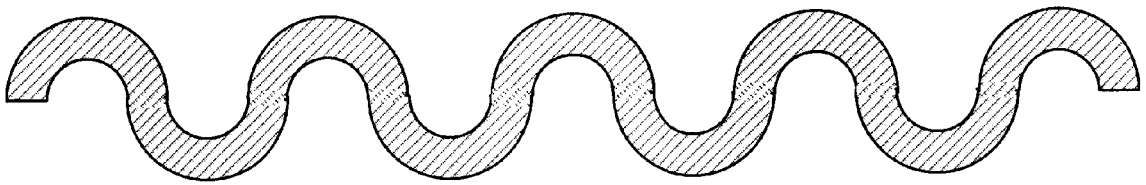
Figure 7D:
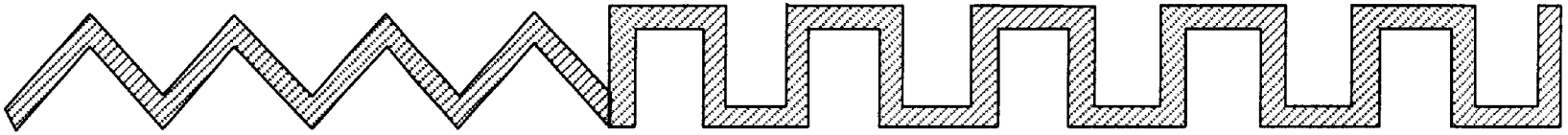
FIGS. 7*d*–7*f* show extended bent patterns formed by a combination of square wave pattern, saw-tooth pattern or sinusoid pattern.
Figure 7E:
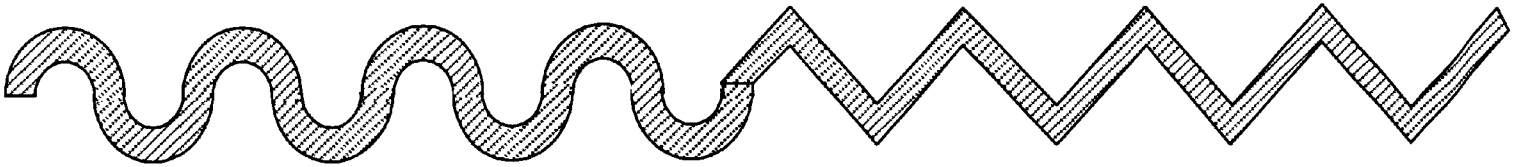
Figure 7F:
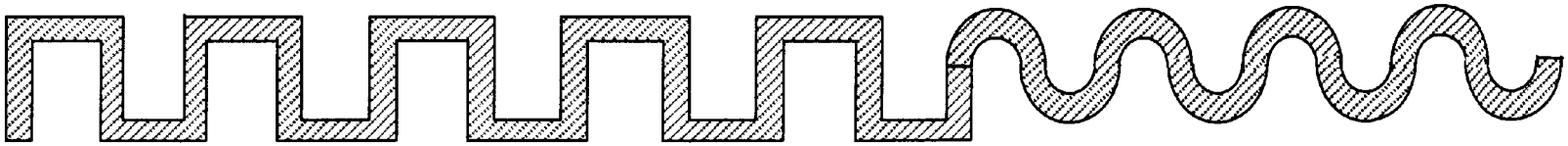

According to the invention, the extended bent wire of the first radiating element 302 has many types of patterns. FIGS. 7*a*–7*c* show three preferred embodiments with a square-wave pattern, a saw-teeth pattern and a sinusuid pattern respectively. Using the extended bent pattern. the overall length of the antenna element can be reduced. Moreover, the extended bent wire of the first radiating element 302 can be a combination of the above-mentioned extended bent patterns as illustrated in FIGS. 7*d*–7*f*. Every extended bent pattern can have different periods or cycles. The central frequency and the bandwidth of the antenna element can be adjusted by controlling the length of the bent metal wire and the number of bends.

Figure 7G:
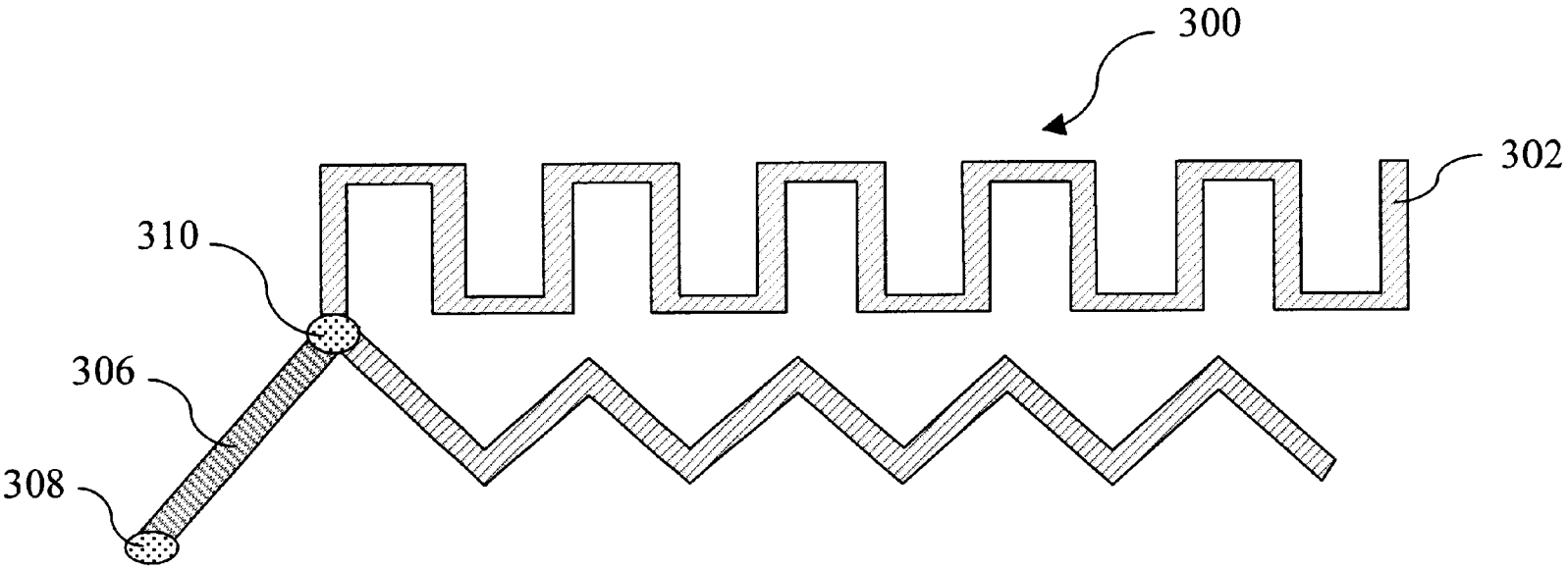
FIG. 7*g* shows an extended bent pattern instead of a straight metal wire being used for the second radiating element.

The second radiating element 304 is a straight conductor used to control the characteristics of the higher frequency band of the antenna and is implemented by a metal wire in the invention. The central frequency and the bandwidth of the higher frequency band of the antenna can be adjusted by controlling the length and the width of the straight conductor. Although a straight metal wire is shown for the second radiating element 304 in the embodiments described above, this straight metal wire may be implemented by means of extended bent patterns as illustrated in FIG. 7*g*.

Figure 8:
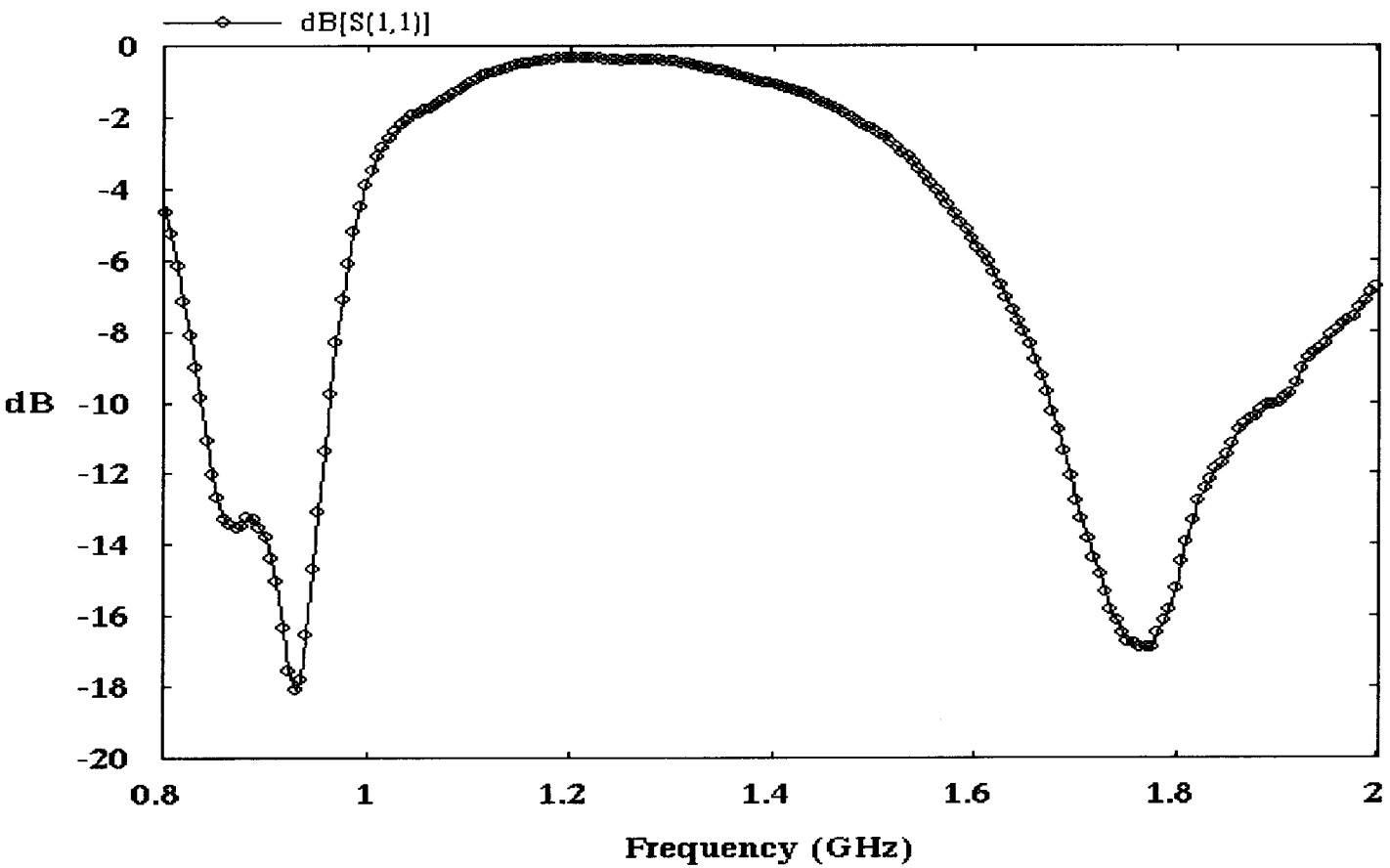
FIG. 8 shows the measurement results of the return loss of an antenna in an embodiment of a two-frequency band antenna according to the invention.
Figure 9:
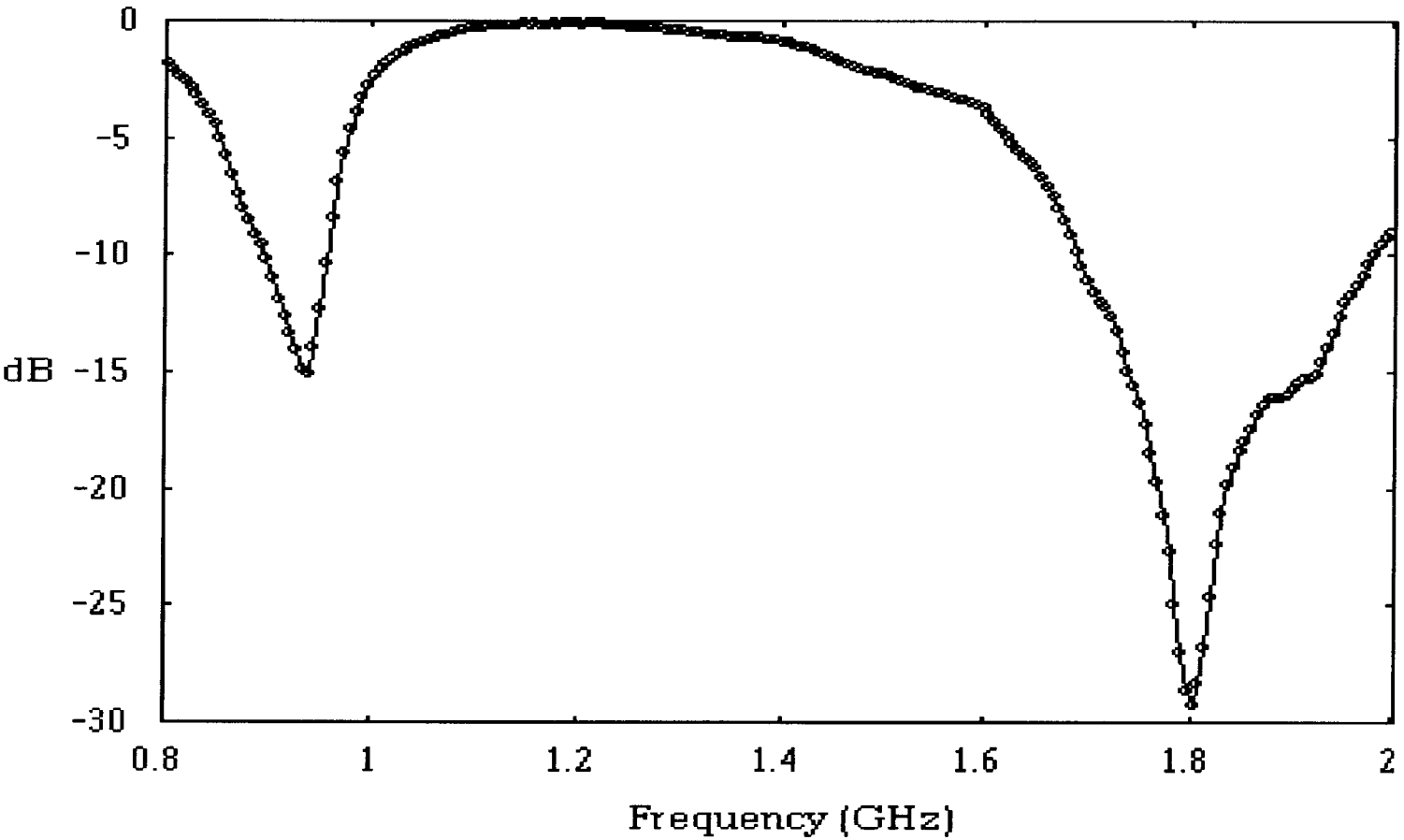
FIG. 9 shows the measurement results of the return loss of an antenna in an embodiment of a commercial three-frequency band antenna according to the invention.

The invention uses an embodiment of a two-frequency band antenna and an embodiment of a commercial three-frequency band antenna to analyze the operating efficiency of the multi-frequency band antenna of the invention. FIG. 8 and FIG. 9 show respectively the measurement results of the return loss in the two antenna embodiments. The horizontal axis represents the resonance frequency of the antenna (unit: GHz) while the vertical axis represents the value of the S-parameter $S_{11}$ (unit: dB). The parameter $S_{11}$ is the ratio of the radio frequency power from antenna port back to the feed circuit to the original feed power, that is, the return loss of the antenna.

In FIG. 8, the operating range of the two-frequency band antenna is designed in GSM 900 and DCS 1800 frequency bands. When $S_{11}$ equals −10 dB, the bandwidths are 130 MHz and 230 MHz, respectively. That is from 841 MHz to 971 MHz, and from 1671 MHz to 1901 MHz. The metal wires of the embodiment are made on a surface of a FR4 base. FIG. 9 shows that the high frequency range of the commercial three-frequency band antenna includes DCS 1800 and Personal Communication System (PCS) 1900 frequency bands.

The multi-frequency band antenna of the present invention has been made to overcome the drawbacks of a conventional antenna and has advantages of having two resonance frequencies, wide frequency bands and being hidden. It can be used in personal wireless communication devices such as cellular phones and short distance wireless communication devices such as wireless home phones, and wireless local area network communication devices.

Although this invention has been described with a certain degree of particularity, it is to be understood that the present disclosure has been made by way of preferred embodiments only and that numerous changes in the detailed construction and combination as well as arrangement of parts may be restored to without departing from the spirit and scope of the invention as hereinafter set forth.

What is claimed is:

1. A multi-frequency band antenna comprising;

a first radiating clement being shaped as an extended bent wire for functioning as an antenna element of a first frequency band, said first radiating element comprising a conductive material;

a second radiating element for functioning as an antenna element of a second frequency band, said second frequency band being different from said first frequency band, said second radiating element comprising a conductive material; and a feed radiating element having a first end being used as a signal feed point for signals of said first and second frequency bands, and a second end being electrically connecting said first radiating element to said second radiating element and forming a top loaded structure;

wherein said feed radiating element is disposed on a plane neither containing nor in parallel with said first and second radiating elements, and said feed radiating element forms an angle in a range between 70° to 180° with a surface containing said first or second radiating element.

2. The multi-frequency band antenna as claimed in claim 1, said feed radiating element being a metal conductor.

3. The multi-frequency band antenna as claimed in claim 1, said feed radiating element being formed by a metal conductor and a base of a dielectric material.

4. The multi-frequency band antenna as claimed in claim 3, said metal conductor being placed on a top surface of said base.

5. The multi-frequency band antenna as claimed in claim 3, said metal conductor being placed on an interior layer of said base.

6. The multi-frequency band antenna as claimed in claim 1, said first and second radiating elements being formed by two metal conductors and a base of a dielectric material.

7. The multi-frequency band antenna as claimed in claim 6, said metal conductors being placed on a top surface of said base.

8. The multi-frequency band antenna as claimed in claim 6, said metal conductors being placed in an interior area of said base.

9. The multi-frequency band antenna as claimed in claim 6, said base having at least two interior layers and said metal conductors being placed in different interior layers.

10. The multi-frequency band antenna as claimed in claim 1, said first and said second radiating elements being coplanar and forming an angle with said feed radiating element.

11. The multi-frequency band antenna as claimed in claim 1, said first and said second radiating, elements being placed on a curved surface.

12. The multi-frequency band antenna as claimed in claim 1, said first radiating element having an extended square-wave pattern.

13. The multi-frequency band antenna as claimed in claim 1, said first radiating element having an extended saw-tooth pattern.

14. The multi-frequency band antenna as claimed in claim 1, said first radiating element having an extended sinusoid pattern.

15. The multi-frequency band antenna as claimed in claim 1, said first radiating element having a pattern which is a combination of at least two patterns selected from the group of extended square-wave pattern, extended saw-tooth pattern and extended sinusoid pattern.

16. The multi-frequency band antenna as claimed in claim 1, said second radiating element being a straight conductor.

17. The multi-frequency band antenna as claimed in claim 1, said second radiating element being an extended bent conductor.

* * * * *

UNITED STATES PATENT AND TRADEMARK OFFICE

CERTIFICATE OF CORRECTION

PATENT NO. : 6,459,413 B1
APPLICATION NO. : 09/758598
DATED : October 1, 2002
INVENTOR(S) : Wen-Jen Tseng and Jyh-Wen Sheen It is certified that error appears in the above-identified patent and that said Letters Patent is hereby corrected as shown below:

Column 1, line 37:
"operating(," should read -- operating --;

Column 3, line 9:
"provide(1" should read -- provided --;

Column 4, line 50:
"sinusuid" should read -- sinusoid --;

Column 5, line 43:
"clement" should read -- element --.

Signed and Sealed this

Fifth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 6,459,413 B1
APPLICATION NO. : 09/758598
DATED : October 1, 2002
INVENTOR(S) : Wen-Jen Tseng and Jyh-Wen Sheen It is certified that error appears in the above-identified patent and that said Letters Patent is hereby corrected as shown below:

Column 5, line 54:
The word "being" should be deleted.

Signed and Sealed this

Twenty-first Day of July, 2009

JOHN DOLL
*Acting Director of the United States Patent and Trademark Office*

US006459413C1

(12) EX PARTE REEXAMINATION CERTIFICATE (10322nd)

United States Patent
Tseng et al.

(10) Number: US 6,459,413 C1
(45) Certificate Issued: Oct. 10, 2014

(54) MULTI-FREQUENCY BAND ANTENNA

(75) Inventors: Wen-Jen Tseng, Kaohsiung (TW); Jyh-Wen Sheen, Hsinchu (TW)

(73) Assignee: Industrial Technology Research Institute, Hsinchu (TW)

Reexamination Request:
No. 90/012,822, Mar. 28, 2013

Reexamination Certificate for:

| | |
|---|---|
| Patent No.: | **6,459,413** |
| Issued: | **Oct. 1, 2002** |
| Appl. No.: | **09/758,598** |
| Filed: | **Jan. 10, 2001** |

Certificate of Correction issued May 5, 2009
Certificate of Correction issued Jul. 21, 2009

(51) Int. Cl.
*H01Q 1/27* (2006.01)

(52) U.S. Cl.
USPC ..... 343/702; 343/700 MS; 343/895

(58) Field of Classification Search
None
See application file for complete search history.

(56) References Cited

To view the complete listing of prior art documents cited during the proceeding for Reexamination Control Number 90/012,822, please refer to the USPTO's public Patent Application Information Retrieval (PAIR) system under the Display References tab.

*Primary Examiner* — Angela M Lie

(57) ABSTRACT

An antenna operable in multiple frequency bands used in a personal wireless communication device comprises a first radiating element, a second radiating element, and a feed radiating element. The first radiating element is shaped as an extended bent wire to function as an antenna for a first frequency band. The second radiating element functions as an antenna for a second frequency band. The feed radiating element has at least two ends. One end is used as a signal feed point so that first and second frequency signals can share the same signal feed point. The other end electrically connects the first radiating element to the second radiating element and forms a top loaded structure. The extended bent wire antenna effectively reduces the overall length of the antenna.

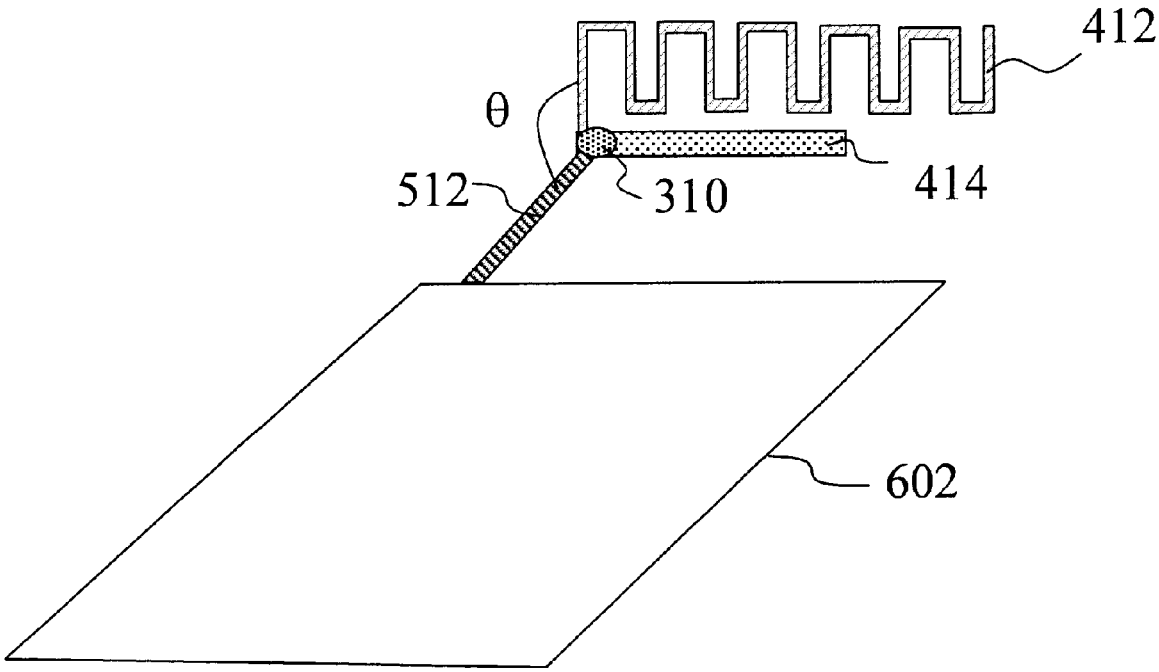

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

New claims 18-30 are added and determined to be patentable.

Claims 2-17 were not reexamined.

*18. The multi-frequency band antenna as claimed in claim 1, said feed radiating element forming an acute angle with said surface containing said first or second radiating element.*

*19. The multi-frequency band antenna as claimed in claim 18, said acute angle being in a range between 70° to 90°.*

*20. The multi-frequency band antenna as claimed in claim 1, said feed radiating element forming an obtuse angle with said surface containing said first or second radiating element.*

*21. The multi-frequency band antenna as claimed in claim 20, said obtuse angle being in a range between 90° to 180°.*

*22. The multi-frequency band antenna as claimed in claim 1, said first and said second radiating elements being non-coplanar and forming multiple angles with said feed radiating element.*

*23. The multi-frequency band antenna as claimed in claim 22, wherein a first of said multiple angles with said feed radiating element has the same value as a second of said multiple angles with said feed radiating element.*

*24. The multi-frequency band antenna as claimed in claim 22, wherein a first of said multiple angles with said feed radiating element has a different value from a second of said multiple angles with said feed radiating element.*

*25. A multi-frequency band antenna comprising:*

*a first radiating element being shaped as an extended bent wire for functioning as an antenna element of a first frequency band, said first radiating element comprising a conductive material contained in a first surface;*

*a second radiating element for functioning as an antenna element of a second frequency band, said second frequency band being different from said first frequency band, said second radiating element comprising a conductive material contained in a second surface; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an angle with one of said first surface or said second surface that is an acute angle in a range between 70° to 90°.*

*26. A multi-frequency band antenna comprising:*

*a first radiating element being shaped as an extended bent wire for functioning as an antenna element of a first frequency band, said first radiating element comprising a conductive material contained in a first surface;*

*a second radiating element for functioning as an antenna element of a second frequency band, said second frequency band being different from said first frequency band, said second radiating element comprising a conductive material contained in a second surface; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an angle with one of said first surface or said second surface that is an obtuse angle in a range between 90° to 180°.*

*27. A multi-frequency band antenna comprising:*

*a first radiating element being shaped as an extended bent wire for functioning as an antenna element of a first frequency band, said first radiating element comprising a conductive material contained in a first curved surface;*

*a second radiating element for functioning as an antenna element of a second frequency band, said second frequency band being different from said first frequency band, said second radiating element comprising a conductive material contained in a second curved surface; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an angle with one of said first curved surface or said second curved surface that is an acute angle in a range between 70° to 90°.*

*28. A multi-frequency band antenna comprising:*

*a first radiating element being shaped as an extended bent wire for functioning as an antenna element of a first frequency band, said first radiating element comprising a conductive material contained in a first curved surface;*

*a second radiating element for functioning as an antenna element of a second frequency band, said second frequency band being different from said first frequency band, said second radiating element comprising a conductive material contained in a second curved surface; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an angle with one of said first curved surface or said second curved surface that is an obtuse angle in a range between 90° to 180°.*

*29. A multi-frequency band antenna comprising;*

*a first radiating element being shaped as an extended bent wire for functioning as an antenna element of a first frequency band, said first radiating element comprising a conductive material;*

*a second radiating element for functioning as an antenna element of a second frequency band, said second frequency band being different from said first frequency band, said second radiating element comprising a conductive material; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an acute angle with a surface containing said first or second radiating element, said acute angle being in a range between 70° to 90°.*

*30. A multi-frequency band antenna comprising;*

*a first radiating element being shaped as an extended bent wire for functioning as an antenna element of a first frequency band, said first radiating element comprising a conductive material;*

*a second radiating element for functioning as an antenna element of a second frequency band, said second frequency band being different from said first frequency band, said second radiating element comprising a conductive material; and*

*a feed radiating element having a first end being used as a signal feed point for signals of said first and second frequency bands, and a second end electrically connecting said first radiating element to said second radiating element and forming a top loaded structure;*

*wherein said feed radiating element is disposed on a plane neither containing nor in parallel with said first and second radiating elements, and said feed radiating element forms an obtuse angle with a surface containing said first or second radiating element, said obtuse angle being in a range between 90° to 180°.*

* * * * *